US010252539B2

(12) United States Patent
Shimizu

(10) Patent No.: US 10,252,539 B2
(45) Date of Patent: Apr. 9, 2019

(54) FLUID EJECTION APPARATUS

(71) Applicant: BROTHER KOGYO KABUSHIKI KAISHA, Nagoya-shi, Aichi-ken (JP)

(72) Inventor: Yoichiro Shimizu, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/713,958

(22) Filed: Sep. 25, 2017

(65) Prior Publication Data

US 2018/0147853 A1 May 31, 2018

(30) Foreign Application Priority Data

Nov. 30, 2016 (JP) ..... 2016-233551

(51) Int. Cl.
*B41J 2/175* (2006.01)
*B41J 2/165* (2006.01)
(Continued)

(52) U.S. Cl.
CPC ..... *B41J 2/17566* (2013.01); *B41J 2/16523* (2013.01); *B41J 2/16526* (2013.01); *B41J 2/175* (2013.01); *B41J 2/1721* (2013.01); *B41J 2/17509* (2013.01); *B41J 2/17553* (2013.01); *B41J 2/17596* (2013.01); *B41J 29/38* (2013.01); *B41J 2/135* (2013.01); *B41J 2/17506* (2013.01); *B41J 2002/17569* (2013.01); *B41J 2002/17589* (2013.01)

(58) Field of Classification Search
CPC ..... B41J 2/04581; B41J 2/04585; B41J 2/03; B41J 2/135; B41J 2/16517; B41J 2/16523; B41J 2/16594; B41J 2/1721; B41J 2/175; B41J 2/17503; B41J 2/17506; B41J 2/17509; B41J 2/17566; B41J 2/17596; B41J 2/30
See application file for complete search history.

(56) References Cited

U.S. PATENT DOCUMENTS

2004/0070641 A1* 4/2004 Inoue ..... B41J 2/14145 347/19
2006/0268076 A1 11/2006 Kaga
(Continued)

FOREIGN PATENT DOCUMENTS

JP 2007-1300 A 1/2007
JP 2007-38656 A 2/2007
(Continued)

*Primary Examiner* — Anh T Vo
(74) *Attorney, Agent, or Firm* — Merchant & Gould P.C.

(57) ABSTRACT

In a fluid ejection apparatus, fluid flows from a tank, through a fluid inlet, to a fluid supply passage which extends to nozzles. A driver is configured to apply energy to fluid in the fluid supply passage to eject fluid from the nozzles. A purge unit is configured to purge fluid from the nozzles to execute first purging. A controller is configured to receive, from a user input unit, a refill completion signal indicating that the tank is refilled with fluid, obtain an amount of fluid consumed since receipt of the refill completion signal by counting an amount of fluid discharged from the nozzles, and determine an amount of fluid to be purged by the first purging by subtracting the amount of fluid consumed from a total capacity of the fluid supply passage.

10 Claims, 9 Drawing Sheets

(51) Int. Cl.

| | |
|---|---|
| ***B41J 2/17*** | (2006.01) |
| ***B41J 29/38*** | (2006.01) |
| *B41J 2/135* | (2006.01) |

(56) References Cited

U.S. PATENT DOCUMENTS

| | | | | |
|---|---|---|---|---|
| 2007/0008368 | A1 | 1/2007 | Maru et al. | |
| 2008/0143764 | A1* | 6/2008 | Kaga | B41J 2/175 347/7 |
| 2009/0058908 | A1* | 3/2009 | Sakurai | B41J 2/1652 347/14 |
| 2009/0079771 | A1* | 3/2009 | Umeda | B41J 2/16532 347/7 |
| 2012/0092716 | A1* | 4/2012 | Ichimura | B41J 2/16505 358/1.15 |
| 2016/0207319 | A1 | 7/2016 | Shirono | |

FOREIGN PATENT DOCUMENTS

| | | | |
|---|---|---|---|
| JP | 2013-230635 | A | 11/2013 |
| JP | 2016-41478 | A | 3/2016 |
| JP | 2016-132163 | A | 7/2016 |
| JP | 2016-159492 | A | 9/2016 |

* cited by examiner

FLUID EJECTION APPARATUS

CROSS-REFERENCE TO RELATED APPLICATION

This application claims priority from Japanese Patent Application No. 2016-233551 filed on Nov. 30, 2016, the content of which is incorporated herein by reference in its entirety.

FIELD OF DISCLOSURE

The disclosure relates to a fluid ejection apparatus.

BACKGROUND

A known fluid ejection apparatus includes an inkjet head having an ink inflow passage, an ink tank for storing ink therein, and an ink supply tube having an ink passage. Ink is supplied from the ink tank to the inkjet head through an ink supply passage which includes the ink passage of the ink supply tube and the ink inflow passage of the inkjet head. Air in the ink supply passage grows in volume with time, which may degrade ejection characteristics of the inkjet head. The volume of ink in the ink supply passage is calculated based on a time elapsed from a reference time, and purging is executed, based on the calculated volume of air, to discharge air together with ink from the ink supply passage.

SUMMARY

It may be beneficial to provide a fluid ejection apparatus in which air is purged from a fluid supply passage to maintain ejection characteristics of the apparatus while reducing excessive fluid consumption.

According to one or more aspects of the disclosure, a fluid ejection apparatus comprises a plurality of nozzles, a tank configured to store fluid therein, a fluid inlet through which fluid flows from the tank, a fluid supply passage extending from the fluid inlet to the nozzles, a driver configured to apply energy to fluid in the fluid supply passage and eject fluid from the nozzles, a purge unit configured to purge fluid from the nozzles and execute first purging, a user input unit configured to receive an input by a user, and a controller. The controller is configured to receive from the user input unit a refill completion signal indicating that the tank is refilled with fluid; obtain an amount of fluid consumed since receipt of the refill completion signal by counting an amount of fluid discharged from the nozzles; and determine an amount of fluid to be purged by the first purging by subtracting the amount of fluid consumed from a total capacity of the fluid supply passage.

BRIEF DESCRIPTION OF THE DRAWINGS

Aspects of the disclosure are illustrated by way of example and not by limitation in the accompanying figures in which like reference characters indicate similar elements.

Figure 5A:
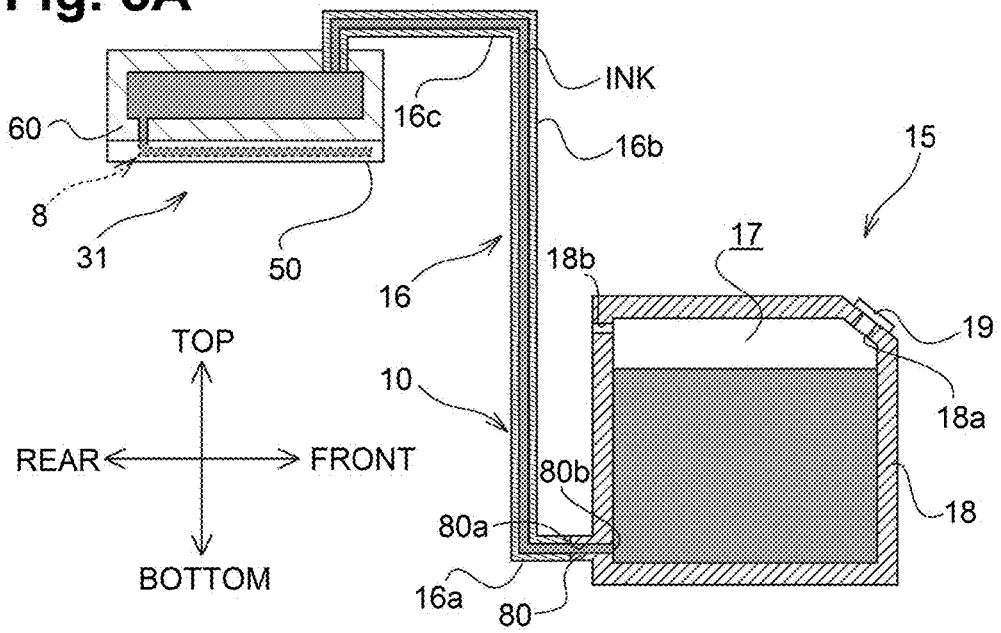
Figure 5B:
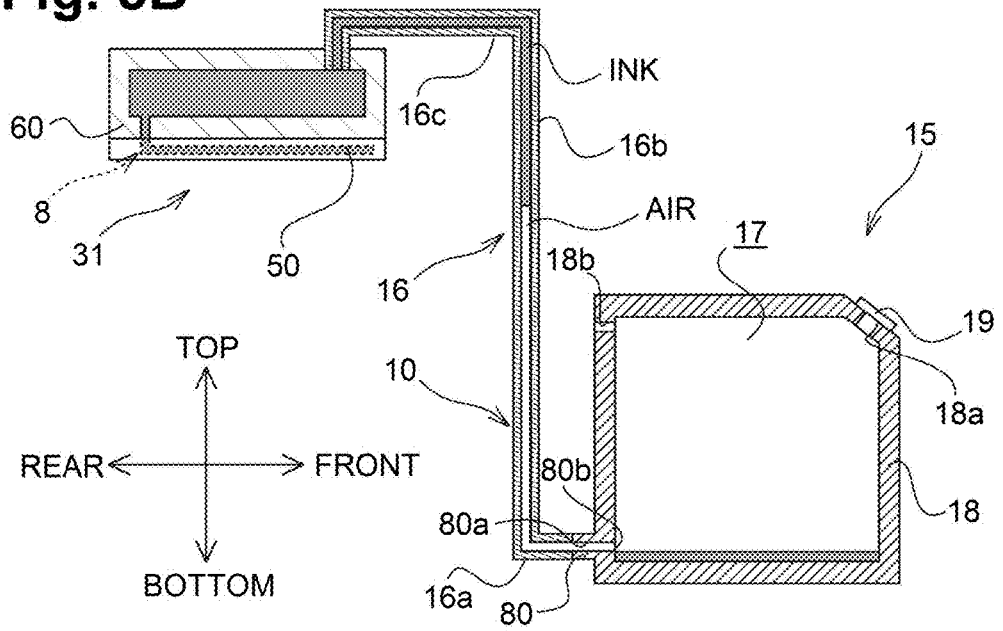

Each of FIGS. 5A and 5B is a schematic vertical cross-sectional view of the inkjet head and an ink tank of the printer in the illustrative embodiment.

Figure 6A:
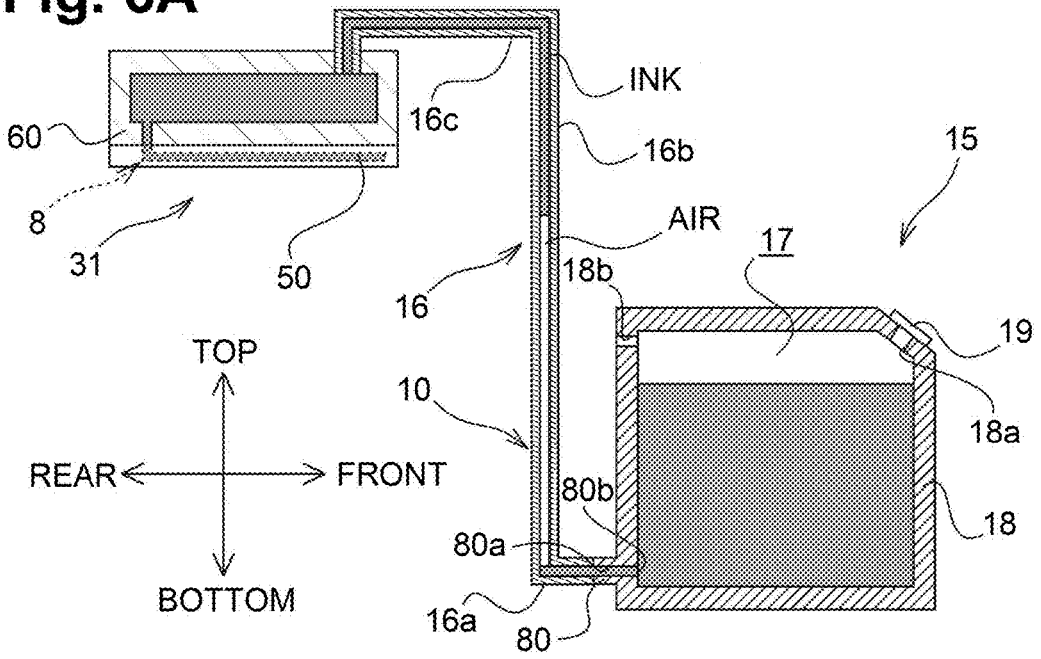
Figure 6B:
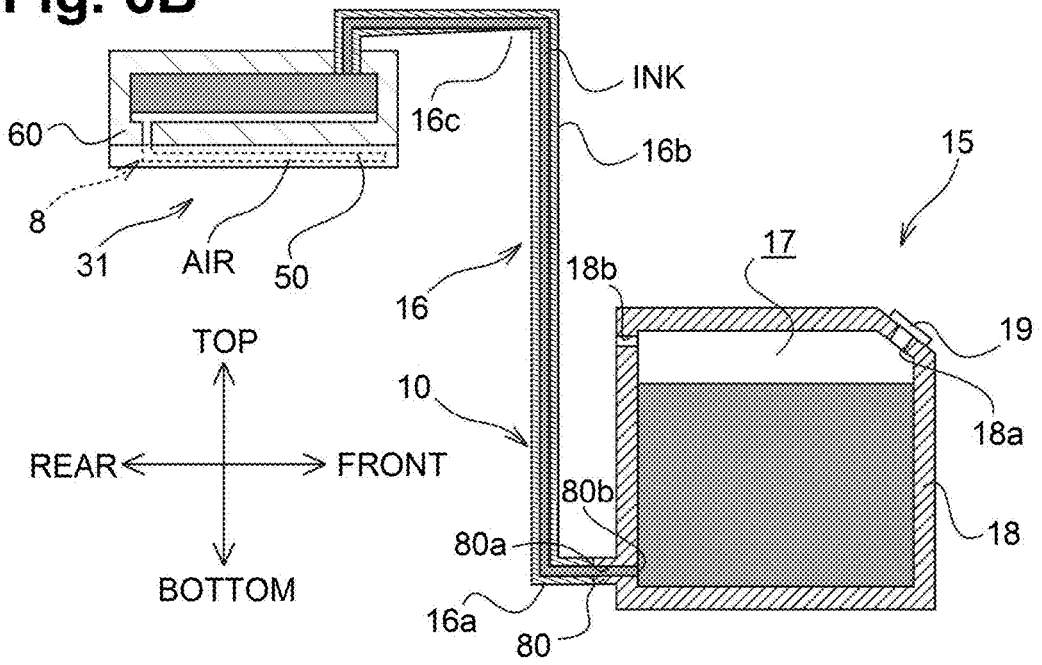

Each of FIGS. 6A and 6B is a schematic vertical cross-sectional view of the inkjet head and the ink tank of the printer in the illustrative embodiment.

Figure 7:
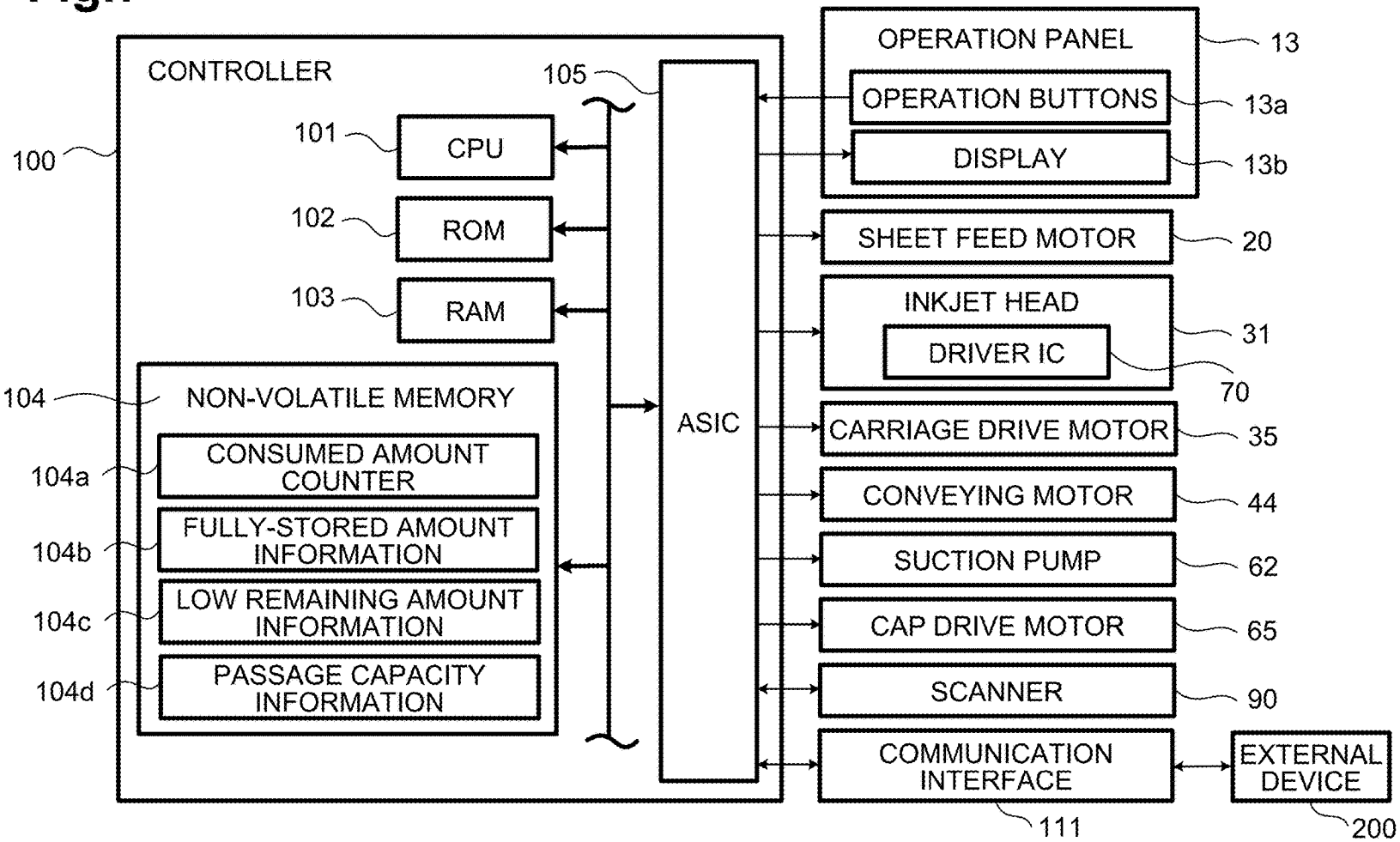

FIG. 7 is a block diagram schematically showing an electrical configuration of the multifunction device in the illustrative embodiment.

Figure 8:
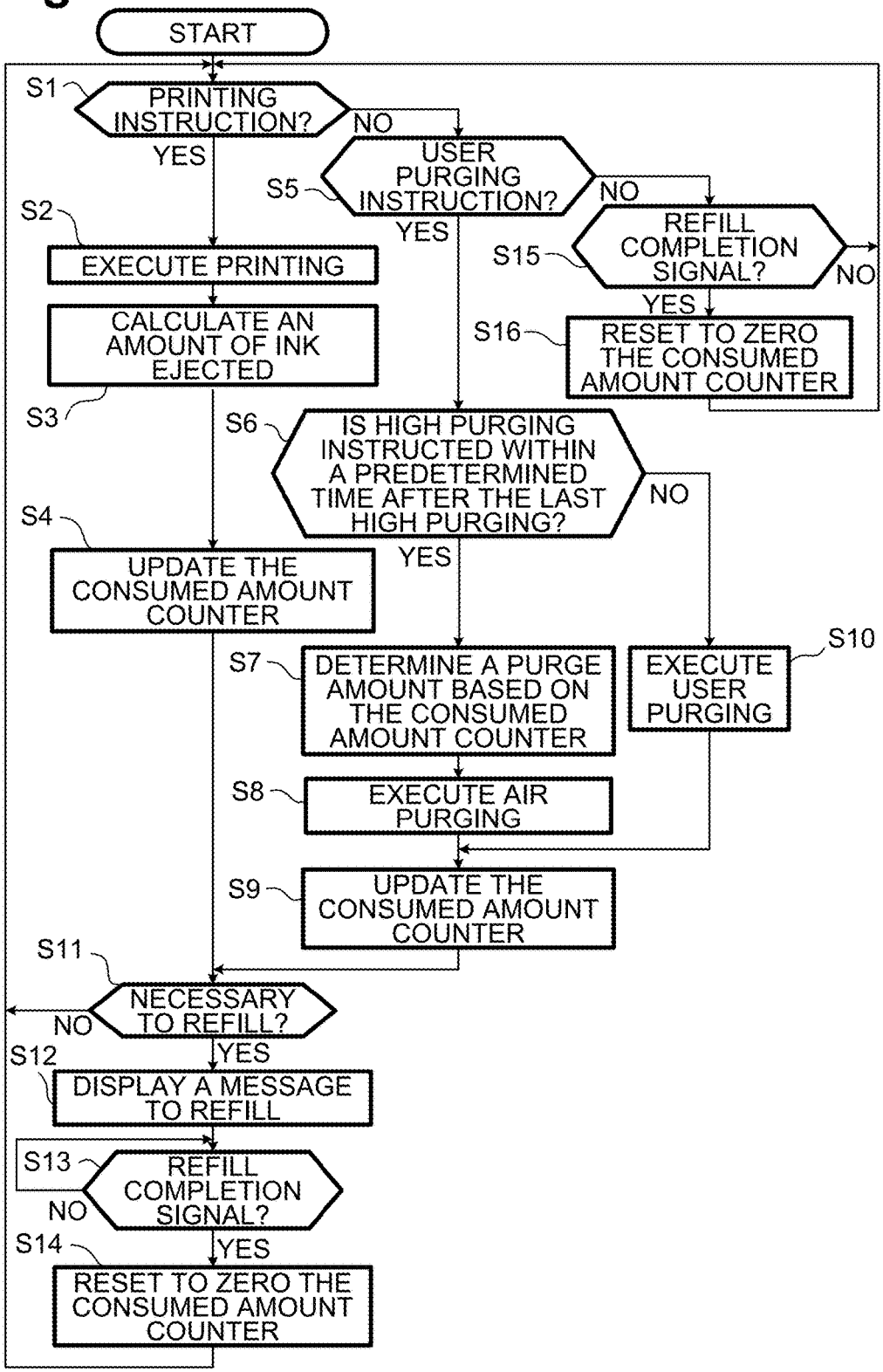

FIG. 8 is a flowchart illustrating processing of the multifunction device in the illustrative embodiment.

Figure 9:
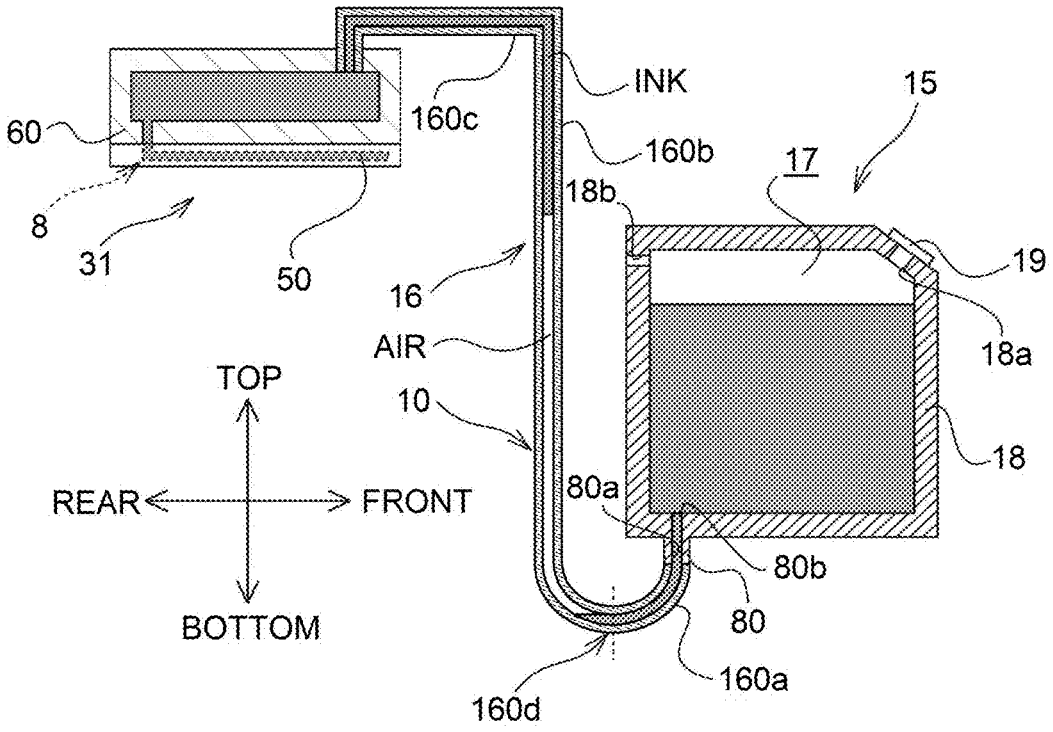

FIG. 9 is a schematic vertical cross-sectional view of an inkjet head and an ink tank of a printer in another illustrative embodiment according to one or more aspects of the disclosure.

DETAILED DESCRIPTION

Figure 1:
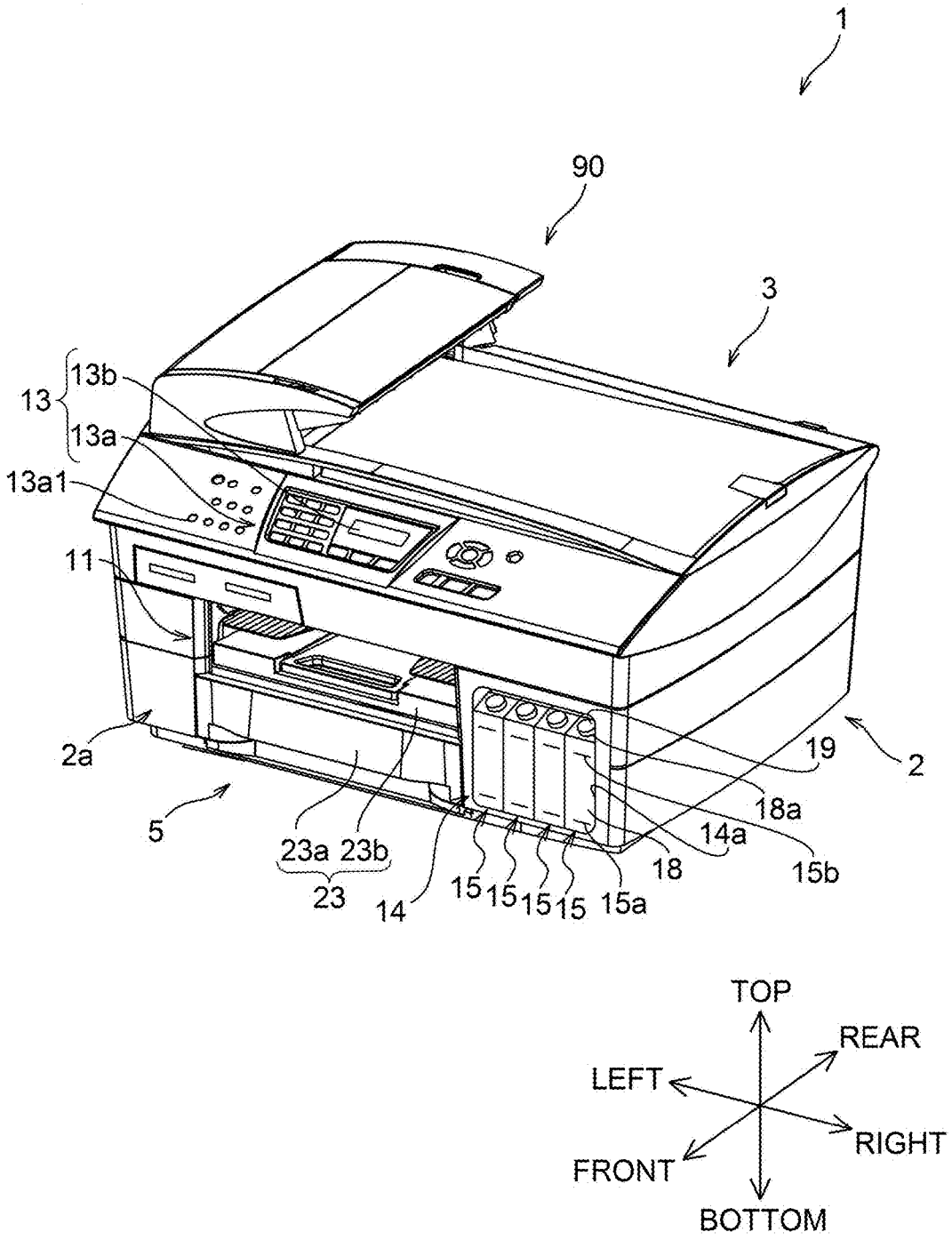
FIG. 1 is a perspective view of a multifunction device in an illustrative embodiment according to one or more aspects of the disclosure.

Hereinafter, an illustrative embodiment of the disclosure will be described with reference to the accompanying drawings. FIG. 1 shows a fluid ejection apparatus, e.g., a multifunction device 1, in an illustrative embodiment according to one or more aspects of the disclosure. As shown in FIG. 1, a top-bottom direction may be defined with reference to an orientation in which the multifunction device 1 may be intended to be used. A side of the multifunction device 1, in which an opening 11 may be provided, may be defined as the front of the multifunction device 1. A front-rear direction may be defined with reference to the front of the multifunction device 1. A right-left direction may be defined with reference to the multifunction device 1 as viewed from its front. The directions defined in FIG. 1 may be applicable to all the drawings. Hereinafter, various parts of the multifunction device 1 will be described with reference to appropriate drawings.

As shown in FIG. 1, the multifunction device 1 is an all-in-one device having a printing function and a scanning function. The multifunction device 1 has a substantially rectangular parallelepiped external shape and includes a printer housing 2 and a scanner housing 3 disposed above the printer housing 2.

Figure 2:
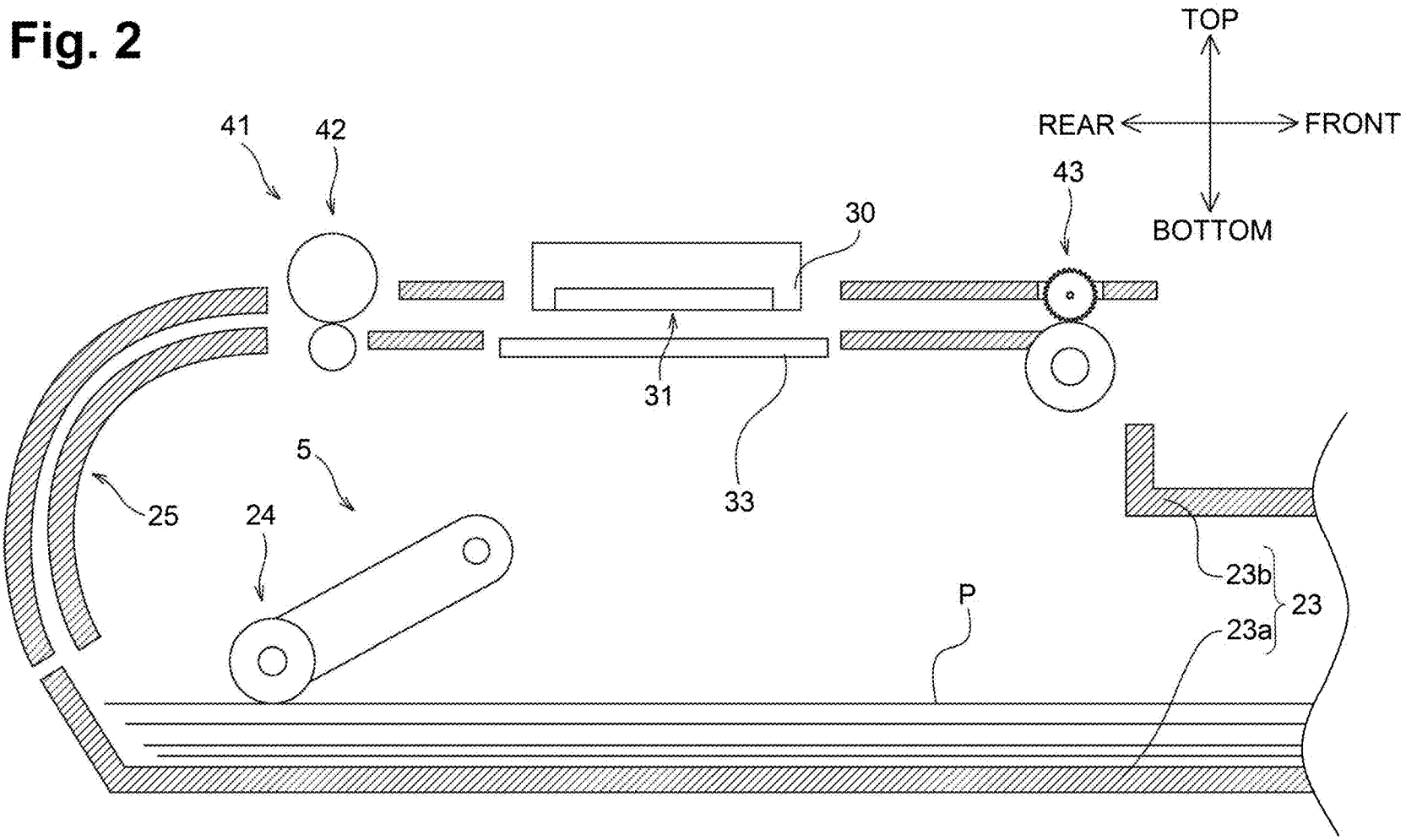
FIG. 2 is a schematic vertical cross-sectional view showing an internal configuration of a printer housing of the multifunction device in the illustrative embodiment.
Figure 3:
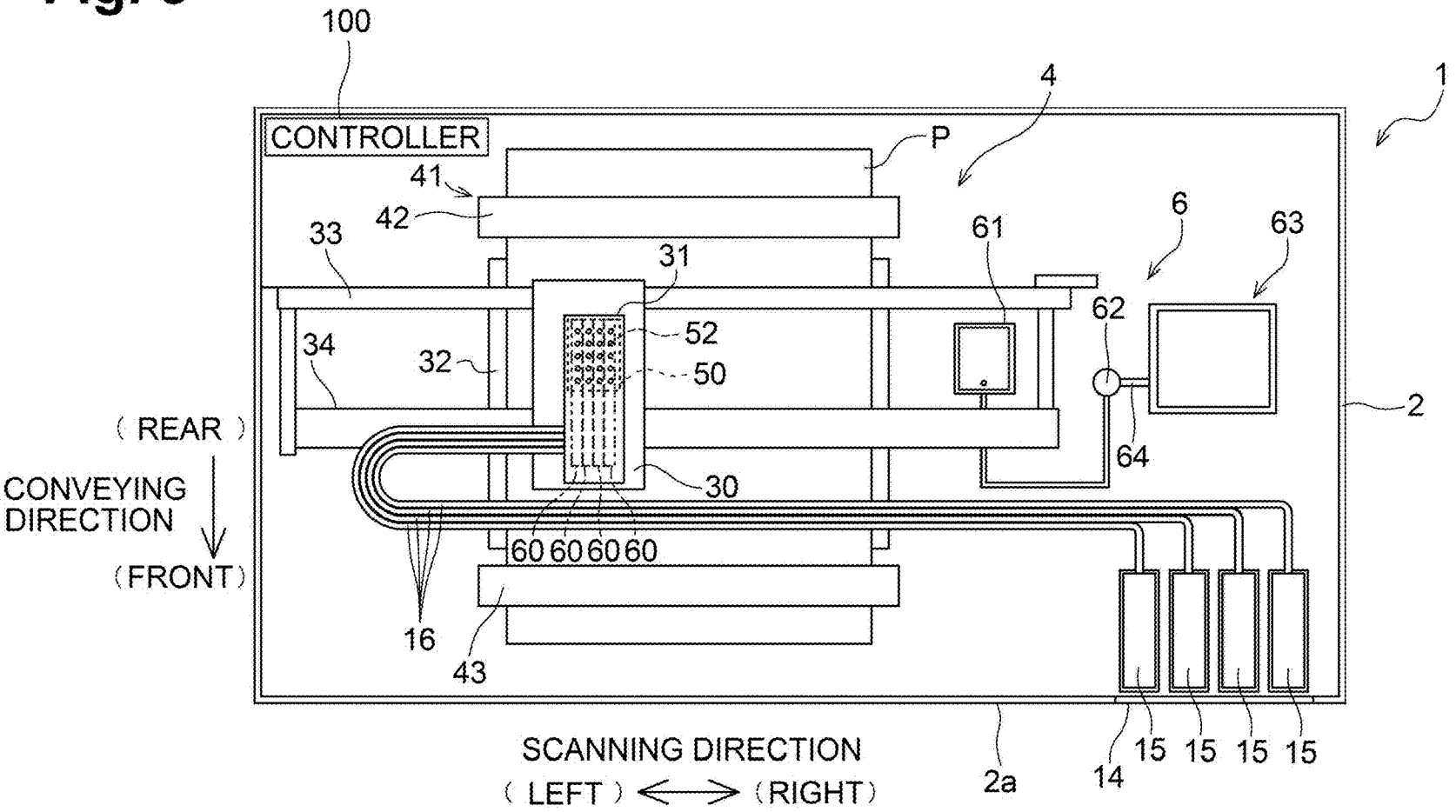
FIG. 3 is a plan view of a printer of the multifunction device in the illustrative embodiment.

As shown in FIGS. 2 and 3, the printer housing 2 includes therein a printer 4, a sheet feeder 5 (refer to FIG. 2), a purge unit 6 (refer to FIG. 3), and a controller 100. As shown in FIG. 1, a front wall 2*a* of the printer housing 2 has an opening 11 at its central portion in the right-left direction. A sheet feed cassette 23 of the sheet feeder 5 is attached into a lower portion of the housing 11

An operation panel 13 is disposed above the opening 11 at the front wall 2*a* of the printer housing 2. The operation panel 13 includes various operation buttons 13*a* and a display 13*b*. The operation buttons 13*a* receive inputs by a user and outputs corresponding signals to the controller 100. The display 13*b* displays various information based on signals from the controller 100.

A plurality of ink tanks 15, for example, four ink tanks 15 for storing black, yellow, cyan, and magenta inks, respectively, are disposed at a right front portion of the printer housing 2. The ink tanks 15 are accommodated inside the printer housing 2 securely so as not to be easily removed from the printer housing 2. The ink tanks 15 are disposed below the inkjet head 31 (refer to FIGS. 5A and 5B).

An openable cover 14 is attached to the right of the opening 11 at the front wall 2*a* of the printer housing 2. The four ink tanks 15 are disposed behind the openable cover 14. The openable cover 14 is pivotably supported by the printer housing 2. The openable cover 14, when at the open position, exposes front portions of the ink tanks 15 and, when at the closed position, covers the front portions of the ink tanks. 15.

The openable cover 14 includes, at its central portion, a light-permeable window 14*a*. Even when the openable cover 14 is at the closed position, the window 14*a* allows a user to visually check the amount of ink remaining in each ink tank 15 inside the printer housing 2.

As shown in FIG. 5, an ink tank 15 includes an ink chamber 17 having a ink storing space, and a substantially rectangular parallelepiped casing 18 enclosing the ink chamber 17. The casing 18 is made of a light-permeable resin and allows a user to externally and visually check the level of ink stored in the ink chamber 17. The casing 18 has an inclined wall formed at a corner between a front wall and an upper wall. The inclined wall has a refill port 18*a* through which ink is supplied into the ink chamber 17. The refill port 18*a* is exposed when the openable cover 14 is at the open position. Ink is supplied by a user by inserting a spout of an ink bottle (not shown) into the refill port 18*a* and pushing the ink bottle. A cap 19 is detachably attached to the refill port 18*a*.

In this illustrative embodiment, the multifunction device 1 does not include a sensor for detecting the ink level in each ink tank 15. This requires a user to visually check the ink level in each ink tank 15.

As shown in FIG. 1, the front wall of the casing 18 has an ink lower line 15*a* and an ink upper line 15*b*. The ink lower line 15*a* notifies a user of timing for refilling the ink tank 15. When the user confirms that the ink level in any ink chamber 17 lowers to the ink lower line 15*a*, the user is required to refill the ink chamber 17 with ink through the refill port 18*a*. The ink upper line 15*b* is positioned at an upper end portion of the ink chamber 17 and indicates the level of ink fully stored in the ink tank 15. The user refills the ink chamber 17 with ink through the ink refill port 18*a* till the ink level reaches the ink upper line.

A rear wall of the casing 18 has, at its upper portion, an air vent through which the ink chamber 17 is in communication with an exterior of the ink tank 15. A tube joint 80 is fixedly attached to a lower portion of the rear wall of the casing 18 so as to interconnect the ink tank 15 and a tube 16. One end of the tube 16, which is flexible, is connected to the tube joint 80, and the other end is connected to a sub-tank 60 (to be described later) of the inkjet head 31. The shape of the tube 16 is maintained by a shape-maintaining member (not shown) located at the ink tank 15. The tube 16 includes a first segment 16*a*, a second segment 16*b*, and a third segment 16*c*. The first segment 16*a* extends in a horizontal direction from its one end connected to the tube joint 80. The second segment 16*b* is connected to the other end of the first segment 16*a* and extends in a direction having an upward vertical component. The third segment 16*c* interconnects the second segment 16*b* and the sub-tank 60.

The tube joint 80 internally defines a joint passage 80*a* extending horizontally. One end of the joint passage 80*a* is connected to the tube 16, and the other end of the joint passage 80*a* functions as an ink inlet 80*b* An upper end of the ink inlet 80*b* is level with the ink lower line 15*a* in the top-bottom direction. Ink in the ink tank 15 is supplied to the sub-tank 60 of the inkjet head 31 through the joint passage 80*a* and the tube 16.

As shown in FIG. 2, the sheet feeder 5 includes the sheet feed cassette 23 attached into the opening 11 of the printer housing 2, and a pickup roller 24 configured to pick up a sheet P from the sheet feed cassette 23. The sheet feed cassette 23 includes a main tray 23*a* configured to support thereon recording media, e.g., sheets P, and a discharge tray 23*a* to receive a sheet P discharged after the printer 4 (to be described later) records an image on the sheet P.

The pickup roller 24 is disposed above the main tray 23*a* and configured to pivot about a pivot shaft disposed at the printer housing 2. The pickup roller 24 is driven by a sheet feed motor 20 (refer to FIG. 7) to pick up one sheet P at a time from the main tray 23*a* of the sheet feed cassette 23. The sheet P picked up by the pickup roller 24 is conveyed upward along a guide 25 and fed to the printer 4.

The printer 4 is disposed above the sheet feeder 5. As shown in FIGS. 2 and 3, the printer 4 includes a carriage 30 configured to reciprocate in the right-left direction (hereinafter also referred to as a scanning direction), and the inkjet head 31 mounted on the carriage 30, and a conveying mechanism 41 configured to convey the sheet P frontward (hereinafter also referred to as a conveying direction) horizontally.

A platen 32 for supporting the sheet P is disposed horizontally in the printer housing 2. As shown in FIG. 3, two guide rails 33, 34 are disposed above the platen 32 and extend parallel to each other in the scanning direction. The carriage 30 is driven by a carriage drive motor 35 (refer to FIG. 7) to move, in a region above the platen 32, along the guide rails 33, 34 while facing the sheet P.

The inkjet head 31 is mounted on the carriage 30 to be spaced apart from the platen 32. A configuration of the inkjet head 31 will now be described in detail.

The inkjet head 31 includes a head body 50 including a plurality of nozzles 52, and four ink sub-tanks 60 disposed on an upper surface of the head body 50 and each configured to temporarily store therein ink supplied to the head body 50. The four sub-tanks 60 are arranged offset from each other in the scanning direction.

Figure 4A:
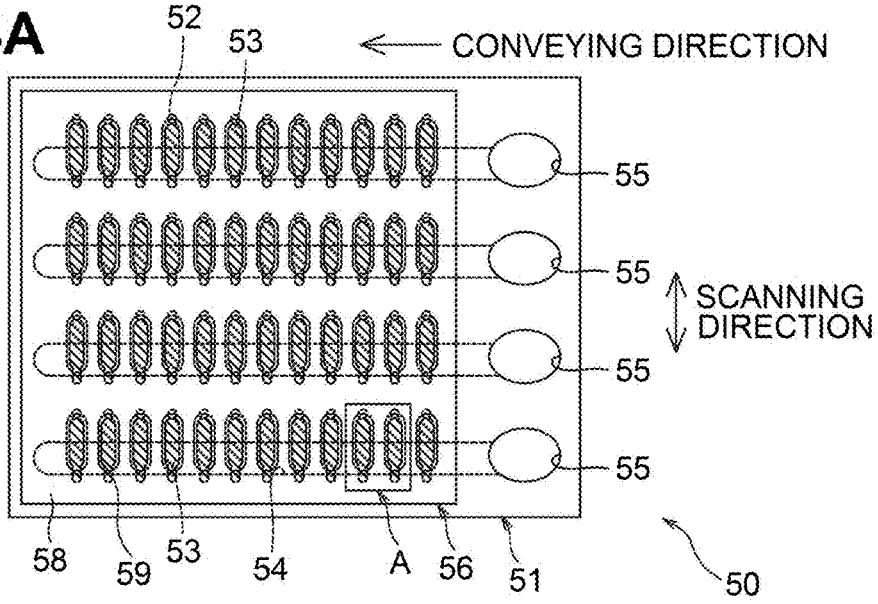
FIG. 4A is a plan view of a head body of an inkjet head of the printer in the illustrative embodiment.
Figure 4B:
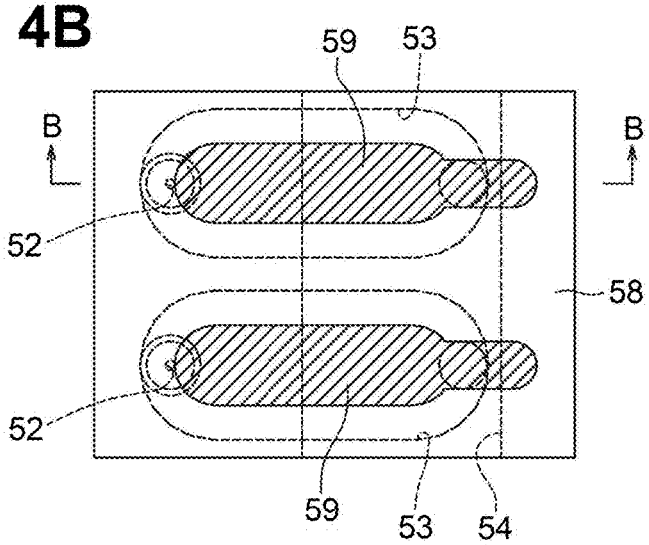
FIG. 4B is an enlarged view of a portion A of the head body in FIG. 4A.

As shown in FIGS. 4A and 4B, the head body 50 includes an ink path structure 51 and a piezoelectric actuator 56 disposed on an upper surface of the ink path structure 51. The ink path structure 51 includes a plurality of nozzles 52 and a plurality of pressure chambers 53 each of which fluidly communicates with a corresponding one of the plurality of nozzles.

Figure 4C:
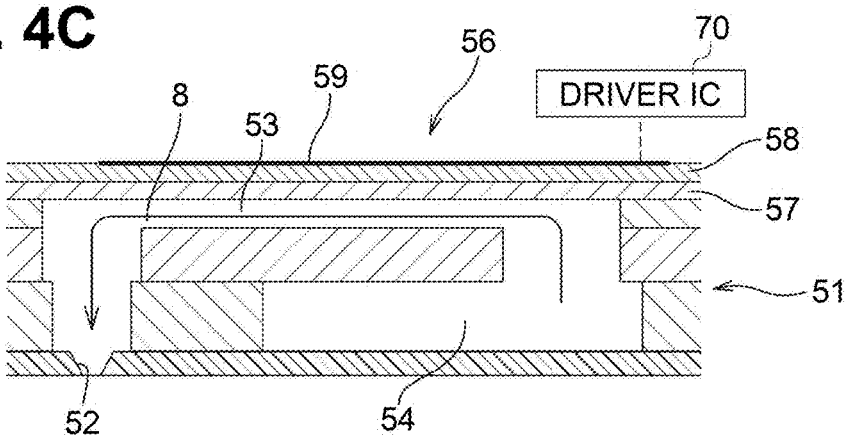
FIG. 4C is a cross-sectional view taken along a line B-B of the portion A in FIG. 4B.

As shown in FIG. 4C, the ink path structure 51 includes four plates stacked one on the other. A lower surface of the ink path structure 51 has the nozzles 52. As shown in FIG. 3, the nozzles 52 are arranged in four arrays such that each array extends in a direction orthogonal to the scanning direction (i.e., in the conveying direction of a sheet P). The four nozzle arrays are in one-to-one correspondence with four colors of ink (e.g., black, yellow, cyan, and magenta).

As shown in FIGS. 4A and 4B, the ink path structure 51 includes the pressure chambers 53 each of which fluidly communicates with a corresponding one of the nozzles. Similar to the nozzles 52, the pressure chambers 53 are arranged in four arrays. The ink path structure 51 further includes four manifolds 54 extending in the conveying direction. Each of the four manifolds 54 supplies a corresponding one of the four colors of ink (e.g., black, yellow, cyan, and magenta) to a corresponding one of the four arrays of pressure chambers 53. Each of the four manifolds 54 is connected to a corresponding one of ink supply ports 55. Accordingly, the ink flow structure 51 has a plurality of ink paths each of which branches off from a corresponding manifold 54, passes through a corresponding pressure chamber 53, and reaches to a corresponding nozzle 52. Hereinafter, ink paths defined in the ink path structure 51 and extending from each ink supply port 55 to corresponding nozzles 52 through a corresponding manifold 54 and corresponding pressure chambers 53 are referred to as a head passage 8.

As shown in FIG. 4C, the piezoelectric actuator 56 includes a diaphragm 57 which covers the plurality of pressure chambers 53, a piezoelectric layer 58 disposed on the diaphragm 57, and a plurality of individual electrodes 59 provided in one-to-one correspondence with the plurality of pressure chambers 53. The individual electrodes 59 are connected to a driver IC (integrated circuit) 70 which drives the piezoelectric actuator 56.

The diaphragm 57 under the piezoelectric layer 58 is made of metal and serves as a common electrode facing, via the piezoelectric layer 58, the plurality of individual electrodes 59. The diaphragm 57 is connected to ground wiring of the driver IC 70 to be maintained at a ground potential.

In the piezoelectric actuator 56, a predetermined driving voltage is applied between an individual electrode 59 and the diaphragm 57 as the common electrode, the piezoelectric layer 58 between the individual electrode 59 and the diaphragm 57 deforms piezoelectrically. This deformation changes the volume of the pressure chamber 53 and applies pressure (ejection energy) to ink in the ink chamber 53. At this time, ink is ejected from the nozzle 52 which is in fluid communication with the ink chamber 53.

As shown in FIGS. 5A and 5B, the sub-tank 60 is connected to the ink supply port 55 (refer to FIG. 4A) and to the ink tank 15 through the tube 16 and the tube joint 80. Hereinafter, for convenience of explanation, an ink path extending from the ink inlet 80*b* to the nozzles 52 is generally referred to as an ink supply passage 10. The ink supply passage 10 includes the joint passage 80*a*, the tube 16, the sub-tank 60, and the head passage 8.

The inkjet head 31 is disposed vertically above the ink tank 15, thereby providing a water head difference between a meniscus formed near the nozzle 52 and the ink level in the ink tank 15. The pressure inside the meniscus is less than the atmospheric pressure. This prevents ink from ejecting from the nozzle 52 when printing is not performed.

As shown in FIG. 3, the conveying mechanism 4 includes two conveying rollers 42, 43 spaced apart from each other in the front-rear direction so as to sandwich the platen 32 and the carriage 30. The conveying rollers 42, 43 are simultaneously driven, by the conveying motor 44 (refer to FIG. 7), to rotate and convey a sheet P between the inkjet head 31 and the platen 32, frontward (in the conveying direction).

In the printer 4 configured as described above, while moving with the carriage in the scanning direction, the inkjet head 31 ejects ink onto a sheet P conveyed by the conveying mechanism in the conveying direction, thereby forming an image on the sheet P.

A purge unit 6 is configured to perform maintenance on the inkjet head 31 to maintain or restore ejection quality. As shown in FIG. 3, the purge unit 6 is disposed, in the scanning direction, outside (to the right of) a sheet conveying zone in which the carriage 30 moves while facing a sheet P. The purge unit 6 includes a cap 61, a suction pump 62, a waste ink collector 63, and a discharge pipe 64. The cap 61 is driven by a cap drive motor 65 (refer to FIG. 7) to move up and down. This allows the cap 61 to move between a cap position and an uncap position. When the carriage 30 faces the cap 61, the cap 61 at the cap position closely contacts an ink ejection surface of the inkjet head 31 and covers the nozzles 52. The cap 61 at the uncap position is separated from the ink ejection surface.

The discharge pipe 64 defines a passage extending from the cap 61, through the suction pump 62, to the waste ink collector 63. The suction pump 62 is connected to the cap 61. The suction pump 62 decreases the pressure inside the cap 61, thereby forcedly discharging ink from the nozzles 52 into the cap 61. This operation is generally called suction purging. Air and debris mixed into ink, and viscous ink may be discharged by suction purging. Ink discharged from the inkjet head 31 by suction purging flows into the waste ink collector 63 through the discharge pipe 64.

As shown in FIG. 1, the scanner housing 3 includes therein a scanner 90. The scanner, including a charged coupled device (CCD) or a contact image sensor (CIS), is instructed by the controller 100 to read an image printed on a sheet P and generate image data of the image.

As shown in FIG. 7, the controller 100 includes a central processing unit (CPU) 101, a read-only memory (ROM) 102, a random-access memory (RAM) 103, a non-volatile memory 104, and an application-specific integrated circuit (ASIC) 105 including various control circuits. Electrically connected to the ASIC 105 are the operation panel 13, the inkjet head 31, the carriage drive motor 35, the conveying motor 44, the suction pump 62, the cap drive motor 65, and the scanner 90.

The ROM 102 stores therein programs and various fixed data to be used by the CPU 101. The RAM 103 temporally stores therein data (e.g., image data) necessary for the CPU 101 to execute programs. The non-volatile memory includes a consumed amount counter 104*a* and stores therein fully-stored amount information 104*b*, low remaining amount information 104*c*, and passage capacity information 104*d*, as will be described later.

A communication interface 111 is also electrically connected to the ASIC 105. Based on a printing instruction transmitted, via the communication interface 111, from an external device 200, the CPU 101 controls, via the ASIC 105, the inkjet head 31 and the carriage drive motor 35 to print an image on a sheet P. The CPU 101 controls, via the ASIC, the suction pump 62 and the cap drive motor 65 to execute suction purging.

Although, in the illustrative embodiment, the single controller 100 is configured to execute various processes, a plurality of CPUs, a single ASIC, a plurality of ASICs, or a combination of a CPU and a particular ASIC may execute various processes.

In the multifunction device 1 according to the illustrative embodiment, the purge unit 6 is controlled by the CPU 101 to execute roughly three types of suction purging: maintenance purging, user purging, and air purging. The purge unit 6 executes maintenance purging and user purging by purging a fixed amount of fluid. In contrast, the purge unit 6 executes air purging by purging a variable amount of fluid. These types of suction purging will now be described in detail.

Maintenance purging and user purging are executed to purge or expel debris, air, and dried viscous ink from the inkjet head 31 and thereby to restore ejection characteristics of the nozzles 52.

Maintenance purging includes periodic purging to be executed when a predetermined time has elapsed after the last printing, and purging to be executed immediately after the power is turned on (except immediately after the power is turned on for the first time).

In user purging, the rotation speed of the suction pump 62 is higher and the drive time of the suction pump 62 is longer than in maintenance purging. Therefore, even when the viscosity of ink in the inkjet head 31 is relatively high and maintenance purging is not effective enough to restore ejection characteristics of the inkjet head 31, user purging may be effective.

In the illustrative embodiment, user purging is classified into three types: low purging, medium purging, and high purging. In medium purging, the rotation speed of the suction pump 62 is higher or the drive time of the suction pump 62 is longer than in low purging. In high purging, the rotation speed of the suction pump 62 is higher or the drive time of the suction pump 62 is longer than in medium purging. Accordingly, the amount of ink purged from the nozzles 52 increases in high purging, medium purging, and low purging in this order.

The above-described user purging is executed in response to a user's operation of the operation panel 13. For example, based on the user's operation of the operation panel 13, the CPU 101 controls the inkjet head 31 and the carriage drive motor 35 to print on a sheet P a test pattern to be checked for any defective nozzles which failed to eject ink. Thereafter, the CPU 101 requests the user to evaluate, through the operation panel 13, the printed test pattern on a scale of L1 to L4. The test pattern is evaluated as L1, L2, L3, and L4 in this order in correspondence with the increasing number of defected nozzles in the printed test pattern. When the user evaluates the printed test pattern as L1, the CPU 101 does not control the purge unit 6 to execute user purging. When the user evaluates the printed test pattern as L2, L3, and L4, the CPU 101 controls the purge unit 6 to execute low purging, medium purging, and high purging, respectively. As described above, user purging is executed based on the user's evaluation of the test pattern thereby reliably restoring ejection characteristics of the inkjet head 31.

Air purging is executed to purge or expel from the nozzles 52, together with ink, air flowing into the ink supply passage 10 through the ink inlet 80*b*. Prior to describing air purging, possible causes for air to flow into the ink supply passage 10 through the ink inlet 80*b* will now be described.

As briefly mentioned above, the multifunction device 1 is not provided with an ink sensor for detecting the amount of ink remaining in the ink tank 15. This disables the CPU 101 to directly check the amount of ink remaining in the ink tank 15. In the illustrative embodiment, the various buttons 13*a* on the operation panel 13 include a refill completion button 13*a*1 (refer to FIG. 1). The refill completion button 13*a*1 should be pressed by a user when the user has refilled the ink tank 15 with ink to the ink upper line 15*b* through the refill port 18*a*. When the CPU 101 receives a signal (hereinafter referred to as a refill completion signal) output based on the user's operation of the refill completion button, the CPU 101 determines that the amount of ink remaining in the ink tank 15 is equal to an amount of ink stored to the ink upper line 15*b* (hereinafter referred to as an amount of ink fully stored in the ink tank 15).

The CPU 101 may calculate the amount of ink ejected from the nozzles 52 by the piezoelectric actuator 56 driven during printing an image, based on image data of the image. The CPU 101 may calculate the amount of ink purged from the nozzles 52 forcedly by the purge unit 6 during suction purging, based on the rotation speed and/or the drive time of the suction pump 62. Thus, the CPU 101 may calculate the amount of ink consumed since receipt of a refill completion signal, by calculating a sum of the amount of ink ejected from the nozzles 52 during printing and the amount of ink purged forcedly from the nozzles 52 during suction purging.

When ink is ejected and/or discharged from the nozzles 52, ink in the ink tank 15 is supplied into the ink supply passage 10 through the ink inlet 80*b* by the amount of ink consumed (i.e. the amount of ink ejected and/or purged from the nozzles 52). The CPU 101 may determine the amount of ink currently remaining in the ink tank 15, based on the amount of ink fully stored in the ink tank 15 and the calculated amount of ink consumed. This allows the CPU 101 to control the display 13*b* to display an alert or message for a user to refill the ink tank 15 when the amount of ink currently remaining in the ink tank 15 (i.e., the ink level) decreases to an amount corresponding to the ink lower line 15*a* (hereinafter referred to as a low amount of remaining ink). In other words, the CPU 101 may control the display 13*b* to display a message to refill the ink tank 15 when the CPU 101 determines that ink is consumed by an amount corresponding to the capacity of an upper space defined above the ink inlet 80*b* in the ink tank 15.

In the illustrative embodiment, the non-volatile memory 104 includes the consumed amount counter 104*a* and stores therein the fully-stored amount information 104*b*, and the low remaining amount information 104*c*. Such information is used for the CPU 101 to calculate the amount of ink currently remaining in the ink tank 15. The consumed amount counter 104*a* counts the count value indicating the total amount of ink consumed (i.e. the total amount of ink ejected and/or purged from the nozzles 52) since receipt by the CPU 101 of a refill completion signal.

The CPU 101 calculates the amount of ink consumed (i.e., the amount of ink ejected and/or purged) each time printing and/or suction purging is executed, and add the calculated amount of ink consumed to update the count value of the consumed amount counter 104*a*. The CPU 101 subtracts the count value from the amount of ink fully stored in the ink tank 105 and determines the resultant value as the amount of ink currently remaining in the ink tank 15. The CPU 101 controls the display 13*b* to display an alert of message for a user to refill the ink tank 15 when the CPU 101 determines that the amount of ink currently remaining in the ink tank 15 reaches the low amount of remaining ink which is indicated by the low remaining amount information 104*c*.

When the user refills the ink tank 15, the ink level in the ink tank 15 does not necessarily reach the ink upper line 15*b* and may be below the ink upper line 5*b*. In this case, the amount of ink determined by the CPU 101 as remaining in the ink tank 15 becomes greater than the actual amount of ink remaining in the ink tank 15. Thus, the CPU 101 fails to control the display 13*b* to display an alert or message even when the actual amount of ink remaining in the ink tank 15 decreases to the low amount of remaining ink. If ink is ejected and/or purged continuously without being supplied by the user, the ink level in the ink tank 15 drops below the ink lower line 15*a*.

When the ink level in the ink tank 15 drops to a lower end of the ink inlet 80*b*, ink is no longer supplied from the ink tank 15 to the ink supply passage 10. However, as long as ink is present in the ink supply passage 10, ink can be discharged from the nozzles 52. Thus, if ink is consumed from the nozzles 52 after ink supply is disabled from the ink tank 15 to the ink supply passage 10, air in the ink tank 15 flows into the ink supply passage 10 by an amount corresponding to the amount of ink consumed, as shown in FIG. 5B.

After that, even when the ink tank 15 is refilled with ink from the refill port 18*a*, air may remain in the ink supply passage 10, as shown in FIG. 6A. More specifically, in the ink supply passage 10, the joint passage 80*a* and the first segment 16*a* of the tube 16 extends from the ink inlet 80*b* horizontally. Thus, when the ink tank 15 is refilled with ink and ink flows from the ink inlet 18*a* into the ink supply passage 10, air present in the joint passage 80*a* and the first segment 16*a* of the tube 16 is discharged into the ink tank 15 due to its own buoyancy. In other words, air present in the joint passage 80*a* and the first segment 16*a* of the tube 16 is displaced by ink. The second segment 16*b* of the tube 16 extends in a direction having an upward vertical component. Thus, in the ink supply passage 10, air present between the nozzles 52 and a joint between the first segment 16*a* and the second segment 16*b* remains continuously even when the ink tank 15 is refilled with ink.

As described above, when the CPU 101 receives a refill completion signal from the operation panel 13, air flown from the ink inlet 80*b* may remain in the ink supply passage 10. Thereafter, when ink is ejected and/or purged from the nozzles 52, air remaining in the ink supply passage 10 moves with ink toward the nozzles 52, as shown in FIG. 6B. The remaining air, when reaches the nozzles, causes the nozzles 52 to fail to eject ink. In this case, when a test pattern is printed on a sheet P to check for any defective nozzles, the printed test pattern is likely to be evaluated by the user as L4.

The amount of air remaining in the ink supply passage 10 depends on the amount of ink consumed (i.e. ejected and/or purged from the nozzles 52) since the ink level in the ink tank 15 has dropped to the ink inlet 80*b*. There may be a case where a relatively large amount of air is present in the ink supply passage 10. In this case, user purging executed by the purge unit 6 several times may not be enough to expel all the air remaining in the ink supply passage 10.

In the illustrative embodiment, the CPU 101 controls the purge unit 6 when the CPU 101 receives, from the operation panel 13, a high purging signal (which corresponds to a user's evaluation of the test pattern as L4) requesting high purging. The CPU 101 controls the purge unit 6 to execute air purging when the CPU 101 receives the high purging signal within a predetermined time (e.g., one hour) after execution by the purge unit 6 of the last high purging. In this case, there is a high possibility that air reaches the nozzles 52.

If, unlike in this illustrative embodiment, an amount of fluid (e.g., air and ink) to be purged is fixed in air purging, similarly in user purging, the fixed amount of fluid to be purged should be equivalent to the total capacity of the ink supply passage 10, in consideration of a case where air is present throughout the ink supply passage 10. Such air purging may restore ejection characteristics of the inkjet head 31. However, excessive ink may be consumed.

The amount of air present in the ink supply passage 10 may be generally estimated based on the amount of ink consumed since the receipt by the CPU 101 of a refill completion signal. More specifically, it is estimated that the amount of air present in the ink supply passage 10 is less than the total capacity of the ink supply passage 10 by at least the amount of ink consumed since the receipt by the CPU 101 of the refill completion signal. Thus, in this illustrative embodiment, an amount of fluid to be purged by air purging is determined based on the amount of ink consumed since the receipt by the CPU of the refill completion signal. More specifically, the non-volatile memory 104 stores therein the passage capacity information 104*d* which indicates the total capacity of the ink supply passage 10. The CPU 101 determines, as an amount of fluid to be purged by air purging, an amount obtained by subtracting the count value of the consumed amount counter 104*a* from the total capacity of the ink supply passage 10 indicated by the passage capacity information 104*d*. In this case, the amount of ink to be consumed is reduced by at least the count value of the consumed amount counter 104*a*, as compared when an amount of fluid to be purged is determined to be equivalent to the total capacity of the ink supply passage 10.

<Processing in Multi-Function Device>

Referring now to FIG. 8, processing executed in the multi-function device 1 in the illustrative embodiment will be described.

First, the CPU 101 determines whether the CPU 101 has received a printing instruction from the external device 200 or the like (e.g., step S1). When the CPU 101 determines that the CPU has received a printing instruction (e.g., Yes at step S1), the CPU 101 controls the inkjet head 31 to print an image on a sheet P (e.g., step S2). The CPU 101 calculates an amount of ink ejected from the nozzles 52 based on image data of the image to be printed (e.g., step S3), and add the calculated amount to a count value of the consumed amount counter 104*a* (e.g., step S4). After step S4, the processing goes to step S11. Although not shown in FIG. 8, when a predetermined time has elapsed after printing at step S2, the CPU 101 controls the purge unit 6 to execute maintenance purging and adds an amount of fluid purged to a count value of the consumed amount counter 104*a*.

In a case where the CPU 101 determines that the CPU 101 has not received a printing instruction (e.g., No at step S1), the CPU 101 determines whether the CPU 101 has received from the operation panel 13 a signal to instruct user purging (e.g., step S5). Signals to instruct user purging includes three types of signals: a low purging signal to execute low purging, a medium purging signal to execute medium purging, and a high purging signal to execute high purging.

In a case where the CPU 101 determines that the CPU 101 has received a user purging instruction signal (e.g., Yes at step S5), the CPU 101 determines whether the CPU 101 has received a high purging signal as the user purging instruction signal within a predetermined time after execution by the purge unit 6 of the last high purging (e.g., Yes at step S6), the CPU 101 determines to control the purge unit 6 to execute air purging instead of user purging. The CPU 101 determines, as an amount of fluid to be purged by the purge unit 6, an amount obtained by subtracting the count value of the consumed amount counter 104*a* from the total capacity of the ink supply passage 10 (e.g., step S7). Then the CPU 101 controls the purge unit 6 to execute air purging to purge the amount of fluid determined at step S7 (e.g., step S8). Thereafter, the CPU 101 adds the amount of fluid determined at step S7 to the count value of the consumed amount counter 104*a* (e.g., S9), and the processing goes to step S11.

In a case where the CPU 101 determines that the user purging instruction signal is not a high purging signal, or that the CPU 101 has received the user purging instruction signal at and after the predetermined time after execution by the purge unit 6 of the last high purging (e.g., No at step S6), the CPU 101 controls the purge unit 6 to execute user purging depending on the user purging instructing signal (e.g., step S10). Thereafter, the CPU 101 adds, to the count value of the consumed amount counter 104*a*, the fixed amount of fluid purged by the user purging executed by the purge unit 6 (e.g., step S9), and the processing goes to step S11.

At step S11, the CPU 101 determines whether an amount obtained by subtracting the count value of the consumed amount counter 104*a* from the amount of ink fully stored which is indicated by the fully-stored amount information 104*b* is less than the low amount of remaining ink which is indicated by the low remaining amount information 104*c*. In a case where the CPU 101 determines that the amount obtained by the subtraction exceeds the low amount of remaining ink (e.g. No at step S11), the CPU 101 determines that the current amount of ink remaining in the ink tank 15 exceeds the low amount of remaining ink, and the processing returns to step S1.

In a case where the CPU 101 determines that the amount obtained by the subtraction is less than or equal to the low amount of remaining ink (e.g., Yes at step S11), the CPU 101 determines that the current amount of ink remaining in the ink tank 15 is less than or equal to the low amount of remaining ink and that it is necessary to refill the ink tank 15 with ink. The CPU 101 controls the display 13*b* to display an alert or message to refill the ink tank 15 (e.g., step S12). In this case, the CPU 101 controls the inkjet head 31 (piezoelectric actuator 56) and the purging unit 6 (suction pump 62) so as not to eject or purge ink from the nozzles 52 until a user operates the refill completion button 13*a*1 (i.e., until the CPU 101 receives a refill completion signal from the operation panel 13) after the CPU 101 determines that the amount obtained by the subtraction is less than or equal to the low amount of remaining ink. This control may prevent a relatively large amount of air from flowing into the ink supply passage 10 through the ink inlet 80*b*.

Subsequently, the CPU 101 determines whether the CPU 101 has received a refill completion signal from the operation panel 13 (e.g., step S13). In a case where the CPU 101 determines that the CPU 101 has not received the refill completion signal (e.g., No at step S13), the processing repeats step S13. In contrast, in a case where the CPU 101 determines that the CPU 101 has received the refill completion signal (e.g., Yes at step S13), the CPU 101 resets to zero the count value of the consumed amount counter 104*a* (e.g., step S14), and the processing returns to step S1.

In a case, at step S5, the CPU 101 determines that the CPU 101 has not received the user purging instruction signal (e.g., No at step S5), the CPU 101 determines whether the CPU 101 has received a refill completion signal from the operation panel 13 (e.g., step S15). In a case where the CPU 101 determines that the CPU 101 has not received the refill completion signal (e.g., No at step S15), the processing returns to step S1. In contrast, in a case where the CPU 101 determines that the CPU 101 has received the refill completion signal (e.g., Yes at step S15), the CPU 101 resets to zero the count value of the consumed amount counter 104*a* (e.g., step S16), and the processing returns to step S1.

As described above, in the illustrative embodiment, the amount of fluid to be purged by air purging is determined based on the amount of ink consumed since receipt by the CPU 101 of the refill completion signal. This may prevent or reduce excessive ink consumption by air purging while the air purging restores the inkjet head 31 to a stable ink ejecting condition.

Maintenance purging and user purging are suction purging in which the purge unit 6 purges a fixed amount of fluid. Thus, unlike for air purging, there is no need for the CPU 101 to determine the amount of fluid to be purged. This allows the CPU 101 to execute, with less control burden, maintenance purging and user purging than when the CPU 101 executes air purging. In the illustrative embodiment, such maintenance purging and user purging may readily restore ejection characteristics of the nozzles 52.

In a case where the CPU 101 receives from the operation panel 13 a user purging instruction signal, which is a high purging signal, within a predetermined time after execution of the last high purging, there is a high chance that air flowing through the ink inlet 80*b* into the ink supply passage 10 reaches the nozzles 52. Thus, in this case, the purge unit 6 is controlled to execute air purging to thereby reliably discharge air present in the ink supply passage 10.

In addition, the purge unit 6 is controlled to execute air purging when there is a high chance that air reaches the nozzles 52. Thus, ink, if present closer to the nozzles 52 than air in the ink supply passage 10 when the ink tank 15 has been refilled with ink, may be used up for printing. This may increase the amount of ink able to be consumed before execution of air purging after the CPU 101 receives a refill completion signal, resulting in a reduction of excessive ink discharge.

In the above-described illustrative embodiment, the ink tank 15 is an example of a tank, the ink inlet 80*b* is an example of a fluid inlet. The ink supply passage 10 extending from the ink inlet 80*b* to the nozzles 52 is an example of a fluid supply passage. The ink supply passage 10 includes the joint passage 80*a*, the tube 16, the sub-tank 60, and the head passage 8. The piezoelectric actuator 56 is an example of a driver. The operation panel 13 is an example of a user input unit. Air purging executed by the purge unit 6 is an example of first purging, and maintenance purging and user purging executed by the purge unit 6 to purge a fixed amount of fluid are each an example of second purging. The user purging instruction signal is an example of a purge request signal.

While the disclosure has been described in detail with reference to the specific embodiment thereof, this is a merely example, and various changes, arrangements and modifications may be applied therein without departing from the spirit and scope of the disclosure.

In the above-described illustrative embodiment, the amount of fluid to be purged by air purging is determined to be an amount obtained by subtracting the count value of the consumed amount counter 104*a* from the total capacity of the ink supply passage 10. However, the amount of fluid to be purged by air purging may be determined at least based on the count value of the consumed amount counter 104*a*. For example, the amount of fluid to be purged by air purging may be determined so as to increase constantly or in a stepped manner as the count value of the consumed amount counter 104*a* increases.

As shown in FIG. 6A, if air is present in the first segment 16*a* of the tube 16 and in the joint passage 80*a*, the air moves, through the ink inlet 80*b*, into the ink tank 15 when ink is supplied from the ink tank 15, through the ink inlet 80*b*, into the ink supply passage 10. The maximum amount of air able to be present in the ink supply passage 10 is equal to an amount obtained by subtracting the capacities of first segment 16*a* and the joint passage 80*a* from the total capacity of the ink supply passage 10. Therefore, the amount of fluid to be purged by air purging may be determined to be an amount obtained by subtracting, from the total capacity of the ink supply passage 10, the count value of the consumed amount counter 104*a* and the capacities of the first segment 16*a* and the joint passage 80*a*. In this case, the amount of fluid to be purged is further reduced by the capacities of the first segment 16*a* and the joint passage 80*a* than in the above-described illustrative embodiment. In this case, the first segment 16*a* of the tube 16 and the joint passage 80*a* are an example of a subspace. The first segment 16*a* of the tube 16 and the joint passage 80*a* are an example of a first passage, and the second segment 16*b* of the tube 16 is an example of a second passage.

In the above-described illustrative embodiment, the tube joint 80 is formed on the rear wall of the casing 18. However, as shown in FIG. 9, a tube joint 80 may be formed on a lower wall of a casing 18. In this case, a joint passage 80*a* of the tube joint 80 extends vertically. The tube 16 is held and shaped, by a holder disposed at the ink tank 15, into a first segment 160*a*, a second segment 160*b*, and a third segment 160*c*. The first segment 160*a* is connected, at its one end, to the tube joint 80 and extends from its one end in a direction having a downward vertical component. The second segment 160*b* is connected to the other end of the first segment 160*a* and extends in a direction having an upward vertical component. The third segment 160*c* connects the second segment 160*b* to the subtank 60. A joint 160*d* between the first segment 160*a* and the second segment 160*b* is U-shaped with its bottom facing downward.

Also, in this alternative embodiment shown in FIG. 9, if air is present in the first segment 160*a* of the tube 16 and the joint passage 80*a*, the air moves, through an ink inlet 80*b*, into an ink tank 15 when ink is supplied, through the ink inlet 80*b*, into the ink supply passage 10. In this case, air present in a portion of the second segment 160*b* moves also, through the ink inlet 80*b*, into the ink tank 15. More specifically, air present in the second segment 160*b* at a portion below an upper end of a passage of the joint 160*d* moves to the ink tank 15. Air, if present in the joint passage 80*a*, the first segment 160*a*, and the portion of the second segment 160*b* is displaced by ink when the ink is supplied into the ink supply passage 10. Thus, in this alternative embodiment, the amount of fluid to be purged by air purging may be determined to be an amount obtained by subtracting, from the total capacity of the ink tank 15, the count value of the consumed amount counter 104*a*, the capacity of the first segment 160*a* of the tube 16, the capacity of the joint passage 80*a*, and the capacity of the portion of the second segment 160*b*. Instead, the amount of fluid to be purged by air purging may be determined without subtracting the capacity of the portion of the second segment 160*b*. In this case, though, the amount of fluid to be purged by air purging becomes greater by the capacity of the subspace in the second segment 160*b*.

In the alternative illustrative embodiment, the first segment 160*a* of the tube 16, the joint passage 80*a*, and the portion of the second segment 160*b* of the tube 16 are an example of a subspace. The first segment 160*a* of the tube 16 and the joint passage 80*a* are an example of a first passage. The second segment 160*b* of the tube 16 is an example of a second passage.

In the above-described illustrative embodiment, the purge unit 6 is controlled to execute air purging when the CPU 101 receives a high purging signal within a predetermined time after execution of the last high purging. Alternatively, the purge unit 6 may be triggered to execute air purging in different manners. For example, the purge unit 6 may be controlled to execute air purging when the CPU 101 predicts, within a predetermined time after execution of the last high purging, a high possibility of air reaching the nozzles 52 based on a scanner's analysis of a test pattern printed on a sheet P. Alternatively, the purge unit 6 may be controlled to execute air purging when the CPU 101 receives a high purging signal within a predetermined time after the high purging executed predetermined times ago (e.g., two times ago). Alternatively, the purge unit 6 may be controlled to execute air purging when the CPU 101 receives a high purging signal within a predetermined time after the suction purging (e.g., maintenance purging or user purging) executed predetermined times ago.

In the above-described illustrative embodiment, the purge unit 6 executes suction purging. Alternatively, a pump may be provided in the middle of the tube 16 to execute pressure purging. The pump may be driven to apply pressure to ink such that ink is supplied to the inkjet head 31 and discharged from the nozzles 52. Still alternatively, a purge unit may be configured to execute suction purging and pressure purging.

Although, in the above-described illustrative embodiment, the inkjet head 31 includes the piezoelectric actuator 56 as a driver for applying ejection energy to ink. Alternatively, as the driver for applying ejection energy to ink, a heater may be provided to heat ink to cause film boiling.

The amount of fluid to be purged in maintenance purging and user purging may be determined based on the count value of the consumed amount counter 104*a*, in a same manner as in air purging. The ink tank 15, which is fixedly disposed in the printer housing 2, may be a cartridge type ink tank detachably attached to a holder disposed in the printer housing 2. The upper end of the ink inlet 80*b* may be positioned below the ink lower line 15*a*.

Although, in the above-described illustrative embodiment, a refill completion signal is used as a trigger for air purging from the ink supply passage 10, other signals may be used. For example, when the ink tank 15 is tilted such that the ink surface becomes below the ink inlet 80*b*, a relatively large amount of air is highly likely to flow into the ink supply passage 10. Thus, a position sensor may be provided to detect the ink tank 15 at a tilted position and a signal output from the position sensor may be used as a trigger for air purging. Also, when the openable cover 14 is opened and closed, there is a high possibility that ink tank 15 is refilled with ink. Thus, a sensor may be provided to detect opening and closing of the openable cover 14 and a signal output from the sensor may be used as a trigger for air purging.

In the above-described illustrative embodiment, the multifunction device 1 is described as an example of a fluid ejection apparatus according to an illustrative embodiment of the disclosure. The disclosure may be applied to a fluid ejection apparatus configured to eject any fluid other than ink.

What is claimed is:

1. A fluid ejection apparatus comprising:

a plurality of nozzles;

a tank configured to store fluid therein;

a fluid inlet through which fluid flows from the tank;

a fluid supply passage extending from the fluid inlet to the nozzles;

a driver configured to apply energy to fluid in the fluid supply passage and eject fluid from the nozzles;

a purge unit configured to purge fluid from the nozzles and execute first purging;

a user input unit configured to receive an input by a user; and a controller configured to:

receive from the user input unit a refill completion signal indicating that the tank is refilled with fluid;

obtain an amount of fluid consumed since receipt of the refill completion signal by counting an amount of fluid discharged from the nozzles; and determine an amount of fluid to be purged by the first purging by subtracting the amount of fluid consumed from a total capacity of the fluid supply passage;

wherein the fluid supply passage defines therein a space including a subspace, and any air present in the subspace is displaced by fluid when supplied from the tank through the fluid inlet into the fluid supply passage, the displaced air moving to the tank through the fluid inlet, and wherein the controller is configured to determine the amount of fluid to be purged by the first purging by subtracting, from the total capacity of the fluid supply passage, the amount of fluid consumed and a capacity of the subspace.

2. The fluid ejection apparatus according to claim 1, wherein the controller is configured to obtain the amount of fluid consumed since receipt of the refill completion signal by summing an amount of fluid ejected by the driver from the nozzles and an amount of fluid purged by the purge unit from the nozzles.

3. The fluid ejection apparatus according to claim 1, wherein the fluid supply passage includes:

a first passage extending from the fluid inlet in one of a horizontal direction and a direction having a downward vertical component; and a second passage connected to the first passage and extending from the first passage in a direction having an upward vertical component, and wherein the controller is configured to determine the amount of fluid to be purged by the first purging by subtracting, from the total capacity of the fluid supply passage, the amount of fluid consumed and a capacity of the first passage.

4. The fluid ejection apparatus according to claim 1, wherein the controller is configured to, when the controller receives from the user input unit a purge request signal requesting purging, control the purge unit to execute the first purging.

5. The fluid ejection apparatus according to claim 1, wherein the purge unit is configured to further execute second purging to purge a fixed amount of fluid from the nozzles, and wherein the controller is configured to, when the controller receives from the user input unit a purge request signal requesting purging, control the purge unit to:

execute the second purging when the controller receives the purge request signal after a predetermined time after the last second purging; and execute the first purging when the controller receives the purge request signal within the predetermined time after the last second purging.

6. The fluid ejection apparatus according to claim 1, wherein the purge unit is configured to further execute second purging to purge a fixed amount of fluid from the nozzles, and wherein the controller is configured to, when the controller receives from the user input unit a purge request signal requesting purging, control the purge unit to:

execute the second purging when the controller receives the purge request signal after a predetermined time after the second purging executed predetermined times ago; and execute the first purging when the controller receives the purge request signal within the predetermined time after the second purging executed predetermined times ago.

7. The fluid ejection apparatus according to claim 1, wherein the purge unit is configured to further execute second purging to purge a fixed amount of fluid from the nozzles.

8. The fluid ejection apparatus according to claim 1, wherein the tank is fixedly connected to the fluid inlet and includes a refill port through which the tank is refilled with fluid.

9. The fluid ejection apparatus according to claim 1, wherein the controller is configured to:

determine whether the amount of fluid consumed since receipt of the refill completion signal becomes equivalent to a capacity of a fluid-storing space above the fluid inlet in the tank, and when the controller determines that the amount of fluid consumed since receipt of the refill completion signal becomes equivalent to the capacity of the fluid-storing space above the fluid inlet in the tank, control the driver such that no fluid is ejected until the controller receives another refill completion signal from the user input unit.

10. A fluid ejection apparatus comprising:

a plurality of nozzles;

a tank configured to store fluid therein and to be refilled with fluid;

a fluid inlet through which fluid flows from the tank;

a fluid supply passage extending from the fluid inlet to the nozzles;

a driver configured to apply energy to fluid in the fluid supply passage and eject fluid from the nozzles;

a user input unit configured to receive inputs by a user;

a controller configured to receive from the user input unit a refill completion signal indicating that the tank is refilled with fluid, and a purge request signal requesting purging; and a purge unit configured to, when the controller receives the purge request signal from the user input unit, be controlled by the controller to execute one of first purging to purge a varying amount of fluid from the nozzles, and second purging to purge a fixed amount of fluid from the nozzles;

wherein the controller is configured to:

when receiving the refill completion signal from the user input unit, start counting an amount of fluid discharged from the nozzles by the driver and by the purge unit to obtain an amount of fluid consumed from the tank;

when receiving the purge request signal from the user input unit, subsequently to the refill completion signal and within a predetermined time after execution of previous second purging, control the purge unit to execute the first purging to purge from the nozzles the varying amount of fluid that is determined by subtracting, from a total capacity of the fluid supply passage, the amount of fluid consumed from the tank; and when receiving the purge request signal from the user input unit, subsequently to the refill completion signal and after the predetermined time after execution of the previous second purging, control the purge unit to execute the second purging to purge the fixed amount of fluid.

* * * * *